US007470062B2

(12) United States Patent
Moteki et al.

(10) Patent No.: US 7,470,062 B2
(45) Date of Patent: Dec. 30, 2008

(54) PACKAGING MEMBER WITH EASY-OPENING MEANS

(75) Inventors: Yoshiji Moteki, Chiyoda-ku (JP); Tooru Ichikawa, Chiyoda-ku (JP); Masahiro Ito, Chiyoda-ku (JP); Kou Go, Chiyoda-ku (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 0 days.

(21) Appl. No.: 11/375,131

(22) Filed: Mar. 15, 2006

(65) Prior Publication Data

US 2006/0188182 A1 Aug. 24, 2006

Related U.S. Application Data

(62) Division of application No. 10/493,242, filed as application No. PCT/JP02/10490 on Oct. 9, 2002.

(30) Foreign Application Priority Data

Oct. 26, 2001 (JP) ..... P2001-329071
Dec. 11, 2001 (JP) ..... P2001-377612

(51) Int. Cl.
*B65D 33/00* (2006.01)

(52) U.S. Cl. ..... 383/200; 229/87.05

(58) Field of Classification Search ..... 383/200, 383/201, 204, 205, 207, 208; 229/87.05
See application file for complete search history.

(56) References Cited

U.S. PATENT DOCUMENTS 2,851,212 A 9/1958 Parmer ..... 383/200
3,608,815 A * 9/1971 Bunch ..... 383/201
4,139,643 A * 2/1979 Hix et al. ..... 426/122
4,176,567 A 12/1979 Weisberg ..... 83/30
4,598,826 A * 7/1986 Shinbach ..... 383/200
4,708,249 A 11/1987 Emslander et al. ..... 206/630
4,874,096 A * 10/1989 Tessera-Chiesa ..... 383/5
5,184,771 A * 2/1993 Jud et al. ..... 229/87.05
5,222,813 A * 6/1993 Kopp et al. ..... 383/200
5,356,068 A * 10/1994 Moreno ..... 229/87.05
5,411,202 A * 5/1995 Fenini ..... 229/87.05
5,437,881 A 8/1995 Jeannin ..... 426/122
5,489,060 A * 2/1996 Godard ..... 229/87.05

(Continued)

FOREIGN PATENT DOCUMENTS

DE 41 07 380 A1 9/1992

(Continued)

*Primary Examiner*—Nathan J Newhouse
*Assistant Examiner*—Jack H Morgan, Jr.
(74) *Attorney, Agent, or Firm*—Steptoe & Johnson LLP

(57) ABSTRACT

A packaging member (1, 80, 100) is provided with easy-opening means (7, 85, 107, 108) for allowing the packaging member to be opened easily, wherein the easy-opening means is either positionally or structurally improved. As one example, the packaging member is a packaging bag (1, 80), in which the easy-opening means serves as a tearing start point when opened with the use of the easy-opening means. The easy-opening portion is formed at a position slightly shifted inward from a perimeter edge of the packaging bag. As another example, the packaging member is a packaging container (100), in which the easy-opening means is structurally improved.

6 Claims, 8 Drawing Sheets

U.S. PATENT DOCUMENTS

| | | | | | |
|---|---|---|---|---|---|
| 5,511,664 | A | * | 4/1996 | Aramaki et al. | 206/525 |
| 5,582,342 | A | * | 12/1996 | Jud | 229/87.05 |
| 5,826,985 | A | | 10/1998 | Goodman et al. | 383/200 |
| 5,897,052 | A | * | 4/1999 | Tanaka et al. | 229/205 |
| 5,934,809 | A | * | 8/1999 | Marbler | 383/208 |
| 5,988,489 | A | * | 11/1999 | Moteki et al. | 229/87.05 |
| 6,102,571 | A | * | 8/2000 | Moteki et al. | 383/208 |
| 6,679,629 | B1 | | 1/2004 | Benito-Navazo | 383/9 |

FOREIGN PATENT DOCUMENTS

| | | | |
|---|---|---|---|
| DE | 197 38 411 | A1 | 3/1999 |
| DE | 100 26 551 | A1 | 11/2001 |
| EP | 0 298 054 | | 1/1989 |
| EP | 0 980 834 | A1 | 2/2000 |
| JP | 9-48471 | | 2/1997 |
| JP | 2001-31111 | | 2/2001 |
| JP | 2002-211584 | | 7/2002 |

* cited by examiner

PACKAGING MEMBER WITH EASY-OPENING MEANS

TECHNICAL FIELD

The present invention relates to a packaging member with easy-opening means, and in particular, to the packaging member, such as a packaging bag with an easy-opening portion and a packaging container with means for allowing the container to be opened easily along a circumstance thereof.

BACKGROUND ART

Various types of packaging members with means for allowing the members to be opened easily have been provided. Such packaging members have been realized as a packaging bag with an easy-opening portion and a packaging container with a pinching portion for easier opening operations.

Specifically, the packaging bag is formed to have an easy-opening portion at a desired position on a predetermined end thereof. The easy-opening portion serves as a tearing start portion for the bag. Hence tearing the bag at the easy-opening portion makes it possible to easily open the packaging bag. Such containing bags include a bag equipped with a notch or a rough surface portion at a predetermined position on a side edge thereof, or a bag with zigzag-shaped gathers formed at predetermined positions on the upper and lower ends thereof.

Such packaging bag is excellent in that, since the easy-opening portion is formed at a position on the perimeter edge of the bag, such as a side end or the upper and lower ends thereof, the bag can be opened very easily.

However, although such a packaging bag could be opened easily, there is a possibility that the bag might be opened accidentally so that its contents are taken out. For example, in the case that the packaging bag with the rough surface portion on a side edge thereof contains medicine, the bag might be opened accidentally by a small child playing with the packaging bag.

Meanwhile, the packaging container with the pinching portion has also been known widely.

Such packaging container is made of a rectangular laminate film material. Specifically, the laminate film material is formed into a cylinder by mutually overlapping two longitudinal side ends of the laminate film material in a palm-to-palm manner. Then, both palm-to-palm portions of the cylinder are joined to each other to have a palm-to-palm joined portion. The palm-to-palm joined portion is then folded toward a main part of the cylinder. One of openings at both ends of the cylinder is closed to form a sealed portion, and in this state, kneaded food, such as sweet jelly of beans, is pressure-filled into the cylinder from the remaining other opening of the cylinder which has not closed yet. Finally, the other opening is closed to form a sealed portion as well, so that the packaging container is entirely formed into a box shape.

The packaging container is normally formed by the laminate film material having damp-proofing and sealing characteristics, and the strength of the palm-to-palm joined portion is also set to a higher value. Thus, the packaging container pressure-filled with kneaded food, such as sweet jelly of beans, is composed so that it cannot be opened easily at the palm-to-palm joined portion.

However, there is a problem that extracting contents from the container is troublesome, because when a user wants to open the packaging container, the user must cut its palm-to-palm joined portion by using an edged tool such as scissors.

In order to solve the foregoing problem, there has been developed a packaging container formed with two cutting portions across the palm-to-palm joined portion thereof. The two cutting lines cross the palm-to-palm joined portion to extend closely to a folding line of the main body of the container, where the two cutting lines face a further cutting line formed at a position near the folding line of the main body. Such a cutting-line formation allows the container to be torn at the palm-to-palm joined portion in an easier manner, so that the container can be opened.

One such practical packaging container has been proposed by Japanese Patent Publication (Laid-open) No. 9 (1997)-104449. According to the publication, the packaging container is formed in a box shape by joining side ends of a laminate film material in a palm-to-palm manner to form a cylindrically shaped body, and by joining circular openings at both ends of the cylindrically shaped body. Two cutting portions are formed at intervals from an end of the palm-to-palm joined portion so as to produce a pinching portion. A fractured straight line is formed in the main part of the laminate film material closely to, but in parallel with a folding line of the main part. Hence contents in the container can be taken out by opening the container along a circumference thereof with pulling the pinching portion outwardly.

The fractured straight line is effective for opening the packaging container, because tearing and pulling outwardly the pinching portion along in a circumferential direction of the container will open the container. However, there is still a possibility that the fractured straight line formed in the main part may be torn when its palm-to-palm joined portion is folded to the main part with a positioning-reliance board applied to the folding line of the palm-to-palm joined portion. Hence there arises a problem that the containers may become defective goods.

SUMMARY OF THE INVENTION

The present invention has been made in consideration of the foregoing various problems about packaging members, such as packaging bags and packaging containers, each of which has means for allowing the bags and containers to be opened easily. An object of the present invention is to provide a packaging bag that can be prevented from being opened accidentally (unintentionally), while still maintaining an easy-opening characteristic.

A second object of the present invention is to provide a packaging container that can be opened along its circumference so that its contents can be taken out, with avoiding a fractured line from being torn apart due to the application of a positioning-reliance board, when a palm-to-palm joined portion is folded toward a main part of the packaging container.

In order to solve the forgoing first object, the present invention adopts, as a packaging member, a packaging bag formed with an easy-opening portion serving as a tearing start portion, characterized in that the easy-opening portion is formed at a position shifted inwardly from a perimeter edge of the packaging bag without passing through the perimeter edge.

According to the present invention, a notch, a rough surface portion, and gathers do not exist on the perimeter edge of the packaging bag. Therefore, only tearing at a position on the perimeter edge thereof makes it almost impossible to open the packaging bag. Since the easy-opening portion is formed at an inside position shifted from a perimeter edge of the packaging bag, the packaging bag can be opened only when the bag is torn with a user's will. In other words, the packaging bag is surely prevented from being opened accidentally.

Moreover, in the above-mentioned packaging bag, the easy-opening portion is a rough surface, which consists of fine uneven portion. And the rough surface is formed shifted inwardly from a side edge of the packaging bag without passing through the side edge.

According to the present invention, the easy-opening portion can be formed inside the side edge very easily. That is, when the easy-opening portion is shifted inside from the side edge, and not on the side edge, the easy-opening portion is obliged to be formed on the front and back of the packaging bag, which are the plane parts of the packaging bag. It is almost impossible to place a notch or gathers on such plane parts, without adding any work to both the inside and outside of the packaging. By contrast, it is easy to produce a rough surface portion consisting of fine uneven portions on a plane part of the container bag by applying a sandpaper etc. to the base material, which constitutes a front surface.

Thus, the packaging bag can be efficiently manufactured through the formation of the rough surface portion, which can provides an easy-opening portion in a simple manner.

The present invention is also provided, as the packaging member, a packaging container. In this container, a rectangular laminate film material is formed to have a box shape by mutually overlapping longitudinal both side edges thereof in a palm-to-palm manner to produce a cylindrical member, the overlapped palm-to-palm portions are joined to produce a palm-to-palm joined portion, the palm-to-palm joined portion is folded toward a remaining main part of the cylindrical member through a folding line set thereon, and a cylindrically shaped opening at each end of the cylindrical member is sealed. The easy-opening means has two cutting lines formed at intervals at an end edge of the palm-to-palm joined portion, and a further cutting line, of which cut depth is within a thickness of the laminate film material, formed at a position on the main part near the folding line so as to face the two cutting lines, both ends of the further cutting line being extended to the palm-to-palm joined portion beyond the folding line to connect or intersect to or with the two cutting portions.

Therefore, no defective container will be produced, at least, on account of the folding of the palm-to-palm joined portion. This is because the further cutting line will not be torn apart, when a positioning-reliance board is applied to the folding line for folding the palm-to-palm joined portion to the main part of the packaging container.

Moreover, in the packaging container of the present invention, a laminate film package material is formed by a monoaxial oriented polypropylene film adjoined by a polyethylene film as a heat adhesion layer. The direction of the axis of the monoaxial oriented polypropylene film is the same as the direction of the cutting portions, so that opening the container along its lateral circumference is possible if the pinching portion formed between the two cutting portions is handled.

BEST MODES FOR CARRYING OUT THE INVENTION

Preferred embodiments in accordance with the present invention will now be described with reference to the accompanying drawings.

FIRST EMBODIMENT

Referring to FIGS. 1-9A to 9C, a first embodiment will now be descried.

Figure 1:
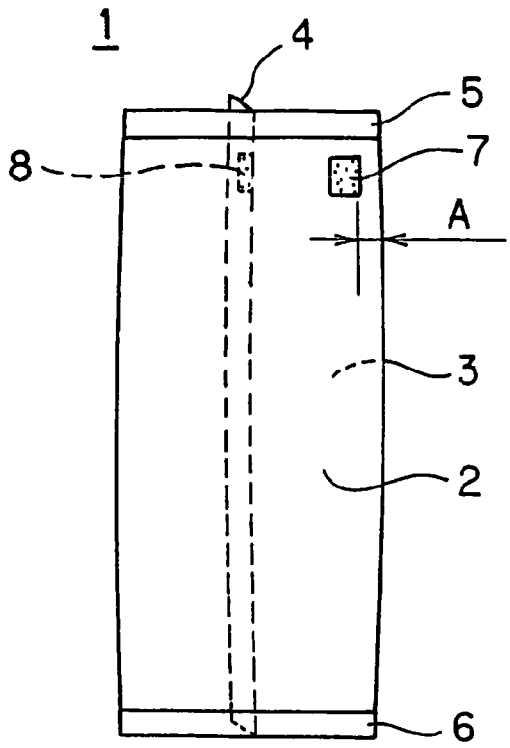
FIG. 1 is the frontal view of a packaging bag, which is explained as a first embodiment of the packaging member according to the present invention.
Figure 2:
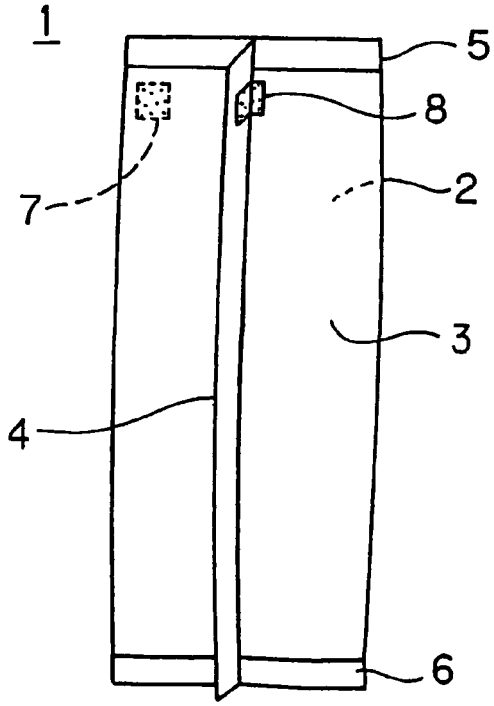
FIG. 2 is the rear view of the packaging bag shown in FIG. 1.

FIG. 1 shows a frontal view of a packaging bag 1 according to a first embodiment, and FIG. 2 is a rear view of the packaging bag 1. The packaging bag 1 comprises a front face 2 that makes the front of the bag, and the rear face 3 that faces the front face 2. Both of the upper end portion 5 and the lower end portion 6 of the packaging bag 1 are heat-sealed to each other, so that the bag is sealed airtightly.

The front face 2 is formed into a flat form, and a rough surface portion 7 functioning as an easy-opening portion is formed at a portion to which the upper part slightly shifted inwardly from a certain side edge. This rough surface portion 7 is formed with plurality of scattered small fine concavities, and when opening the packaging bag 1, it acts as a tearing start point from which the tearing starts, which may be explained later. In addition, the edge of the rough surface portion 7 is located inwardly and distant from the side edge of the packaging bag 1, so that the rough surface portion 7 does not reach the side edge of the packaging bag 1. In the case of FIG. 1, the rough surface portion 7 is surely apart by a distance "A" from the side edge.

On the other hand, the rear heat-sealed portion 4, which is placed at the center of the right-and-left direction of the rear face 3 so as to stand outward and extend in the longitudinal direction of the packaging bag. Mutually heat-sealing the side edges of the laminate film (which is the material of the packaging bag 1) forms the rear heat-sealed portion 4. Furthermore, a rough surface portion 8 is formed on one side of this rear heat-sealed portion 4. This rough surface portion 8 is formed for assisting the tearing work when opening the packaging bag 1, with the result that the opening work may not be interrupted by the rear heat-sealed portion 4.

The surface in which this rough surface portion 8 is formed, in the right-and-left direction of the packaging bag 1, is disposed in the surface counter to the side edge of the opposite position of the rough surface portion 7 serving as the easy-opening portion was formed. Further, each of the heat-sealing portions, which seal the packaging bag 1, are formed on the upper end portion 5 and the lower end portion 6 of the packaging bag 1, at each position which occupies a predetermined width from the end, respectively.

However, a notch is not formed on the side edges of this packaging bag 1. Moreover, zigzag gathers are not formed on both of the upper end portion and the lower end portion. Thereby, the packaging bag 1 is prevented, in a remarkably steadier manner, from being opened accidentally.

Figure 3:
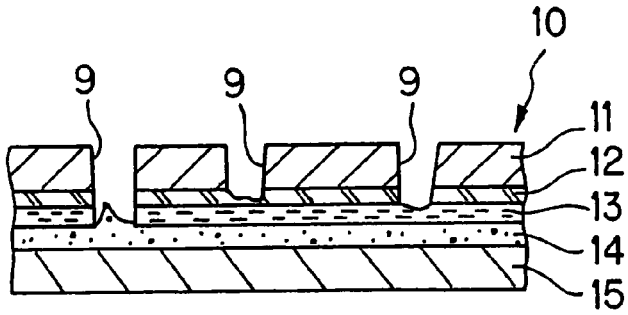
FIG. 3 exemplifies the layer structure of a laminate film that composes the packaging bag shown in FIG. 1.

FIG. 3 shows an example of a layer structure of the laminate film 10. The laminate film 10 described in FIG. 3 does not include an aluminum foil layer, for example, while a PET (polyethylene terephthalate) film layer 11 serving as a base layer of the laminate film 10, which is placed on the outer surface of the packaging bag 1, is combined with a PE (polyethylene) film layer 15, which is placed on the inner surface thereof, through adhesive 14.

The PET film layer 11 serving as the outer layer is provided on its inner surface with a PVDC (polyvinylidene chloride) coating layer 12 to impart the oxygen-barrier property to the laminate film 10. The PVDC coating layer 12 is provided on its inner surface with a printing layer 13 on which characters and patterns for the packaging bag 1 appears. The adhesive 14 connecting the PET film layer 11 with the PE film layer 15 exists between the printing layer 13 and the PE film layer 15.

A biaxial oriented film having a thickness of 12 ì m is utilized to form the PET film layer 11 serving as the outer layer and the inner surface of the PET film layer 11 is coated with the PVDC film layer having a thickness of about 3 ì m. A PE film having a thickness of 70 ì m is utilized to form the PE film layer 15 serving as the inner layer. Further, a dry-laminate adhesive or a solventless adhesive is used as the adhesive 14 for connecting the outer and inner layers.

In FIG. 3, though the inner surface of the PET film layer 11 is provided with the PVDC coating layer 12, a vapor deposited layer may be substituted for the above-mentioned PVDC coating layer 12 to provide an excellent barrier property. Depositing the inner surface of the PET film layer 11 with metal such as $Al_2O_3$ and $SiO_2$ forms such a vapor deposited layer.

Moreover, in the configuration shown in FIG. 3, the laminate film 10 has been exemplified with no aluminum foil layer included. However, the laminate film can include an aluminum foil layer. When a packaging bag is produced using the laminate film with such an aluminum foil layer, the barrier property of the bag can be raised further.

Concavities 9, having a predetermined depth from the outer layer of the laminating film 10 shown in FIG. 3, are the individual fine concavities forming the rough surface portion 7. Pluralities of these concavities 9 are scattered to produce the rough surface portion 7.

Figure 4:
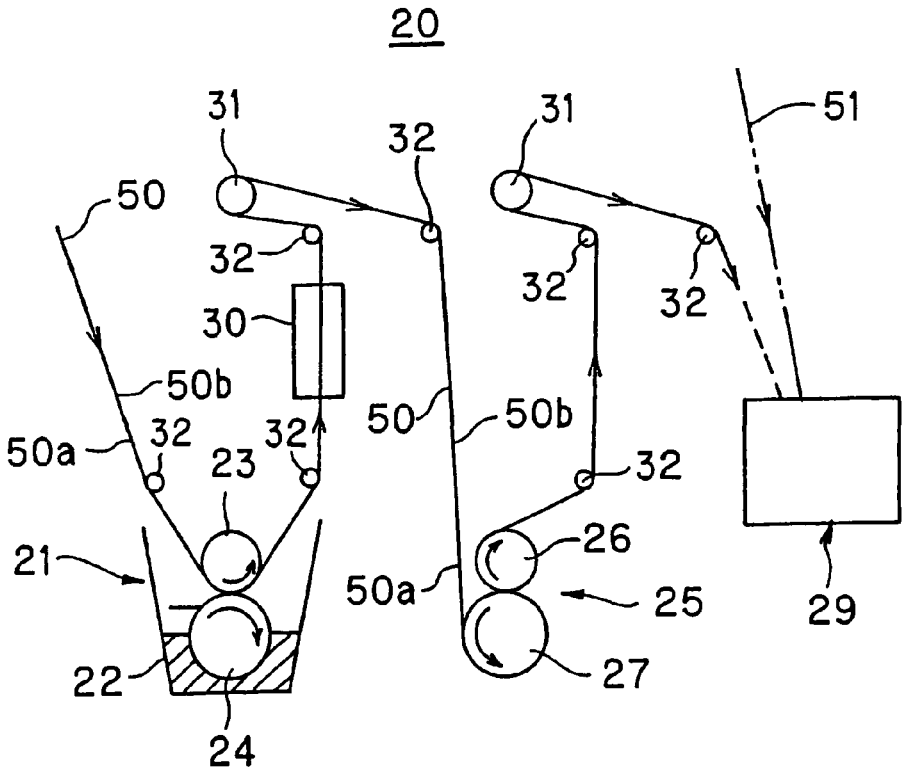
FIG. 4 is a diagram showing a laminate film forming apparatus for forming the laminate film shown in FIG. 3.
Figure 5:
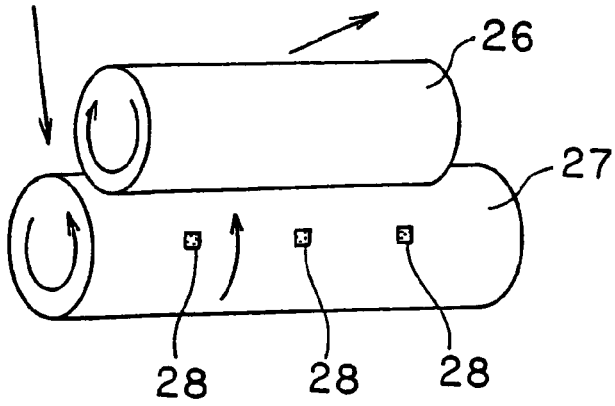
FIG. 5 is a diagram showing a rough surface-forming device for forming a rough surface portion on the laminate film.

FIG. 4 illustrates an apparatus 20 for forming the laminate film, which produces the packaging bag of the present invention. A laminate film forming apparatus 20 is composed of a printing device 21, a rough surface forming device 25, and a lamination device 29. The printing device 21 is used to apply a printing step to a single surface 50*a* of the strip-shaped PET film 50 serving as the base layer. The rough surface-forming device 25 forms a rough surface portion on a surface 50*b* opposite to the printed surface 50*a*. The lamination device 29 laminates, on the strip-shaped PET film 50, a strip-shaped PE film 51 serving as the inner layer in the laminate film in such a manner that both the films 50 and 51 can be joined to each other. The printing step, the rough surface-forming step, and the lamination step are applied in this order to the strip-shaped PET film 50 serving as the base material, while the PET film 50 travels in the longitudinal direction.

The printing step is first applied to the strip-shaped PET film 50, which has been fed from the left-hand side in FIG. 4. During the printing step, the single surface 50*a* of the strip-shaped PET film 50 is subjected to printing of characters and/or designs with the use of the printing device 21. The printing device 21 is composed of a gravure printing device, in which the PET film 50 travels between a lower roller 24, which is immersed into ink received in a tank 22, and a blanket roller 23, which is placed above the lower roller 24, so as to carry out the printing step.

The strip-shaped PET film 50, of which one surface has been subjected to the printing step, is conveyed through a drying device 30 to the rough surface forming device 25, while being guided by means of guide rollers 31 and 32. The rough surface-forming device 25 is composed of a rubber roller 26, which is placed on the upper side and a rough surface forming roller 27, which is placed on the lower side so as to come into contact with the rubber roller 26. On the peripheral surface of the rough surface-forming roller 27 are provided three pieces of sandpaper 28 shaped into a rectangle, respectively. The three pieces of sandpaper 28 are placed in the longitudinal direction of the rough surface forming roller 27 at predetermined intervals.

The strip-shaped PET film 50 conveyed to the rough surface forming device 25 is wound around the rough surface forming roller 27 from its lower side so that the surface 50*b* opposite to the printed surface 50*a* comes into contact with the peripheral surface of the rough surface forming roller 27. The strip-shaped PET film 50 is then guided along the peripheral surface of the rough surface forming roller 27 in the counterclockwise direction in FIG. 4, and then held between the rough surface forming roller 27 and the rubber roller 26. When the rough surface forming roller 27 rotates so that the pieces of sandpaper 28 provided on the roller 27 reach their uppermost positions, the strip-shaped PET film 50 is held between the pieces of sandpaper 28 and the periphery of the rubber roller 26 so as to make the rough surface portions on the surface 50*b*. As a result, the rough surface portions are formed at prescribed positions on the surface 50*b* of the strip-shaped PET film 50 in its width direction, with the rough surface portions formed at intervals in the longitudinal direction of the film 50.

It is preferable to use, as the sandpaper attached on the rough surface forming roller 27, pieces of sandpaper of grain sizes #100 to #120 in which molten aluminum is dispersed. There may be used another piece of sandpaper with fine projections made of dispersed material such as silicon carbide, boron carbide, emery powder, or sand in addition to molten aluminum. The member for forming the rough surface portions is not limited only to the pieces of sandpaper, but may be a metallic plate having a plurality of projections, which is attached on the peripheral surface of the rough surface forming roller 27.

After the rough surface portions are formed on the surface 50*b* of the strip-shaped PET film 50, the film 50 is conveyed to the lamination device 29, while being guided by means of guide rollers 31 and 32. At the lamination device 29, the printed surface 50*a* of the conveyed strip-shaped PET film 50 is layered on the strip-shaped PE film 51 conveyed from another route. They are joined to accomplish one layer, so that a single strip-shaped laminate film 52 is formed.

Figure 6:
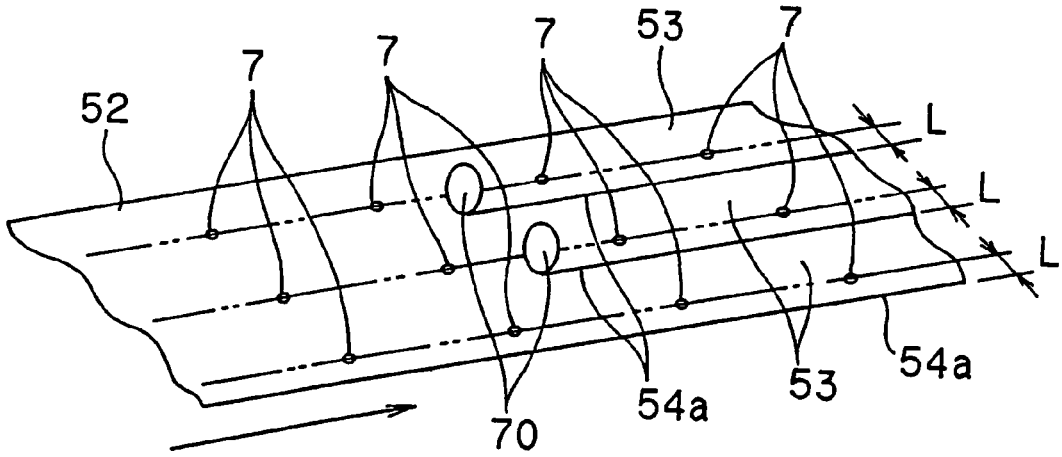
FIG. 6 is a diagram showing a process for slitting in a predetermined width the laminate film composing the packaging bag.
Figure 7:
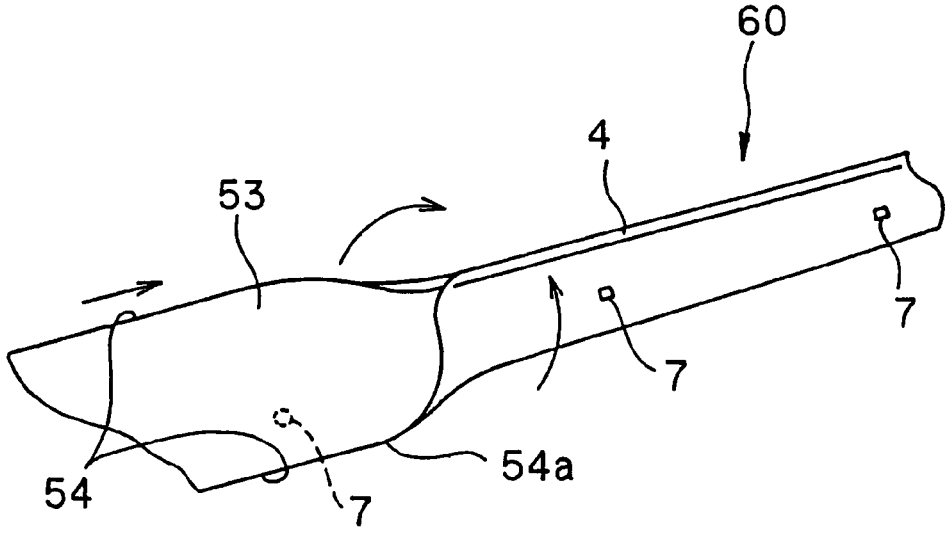
FIG. 7 is a diagram showing a process for forming the slit laminate film into a cylindrical body.

The laminate film 52 is then conveyed to the slitting process, where the laminate film 52 is slit into three parts equally in its width direction. FIG. 6 shows the state of the laminate film 52 to be slit. The slitting operation is carried out, as shown in FIG. 6, by disk-like cutters 70 arranged in the width direction of the laminate film 52 being conveyed. In this circumstance, the laminate film 52 is slit so that each rough surface portion 7 is located a predetermined distance L apart from a side edge 54*a* of each laminate film 53 that has been slit, respectively. The location determined by this predetermined distance L is accord with a position shifted inward from the side edge in the bag, when the packaging bag 1 is formed. As shown in FIG. 7, each laminate film 53 that has been slit is subjected to the next process, whereby both longitudinal ends 54 are rounded so that both longitudinal ends are in a palm-to-palm state across a predetermined width Heat-sealing the portion of both side ends 54 along their longitudinal direction then forms a long cylinder 60, where both side ends 54 are mutually joined in a palm-to-palm manner. The heat-sealed palm-to-palm joined portion 4 stands outward in the radius direction of the formed cylinder 60.

Figure 8:
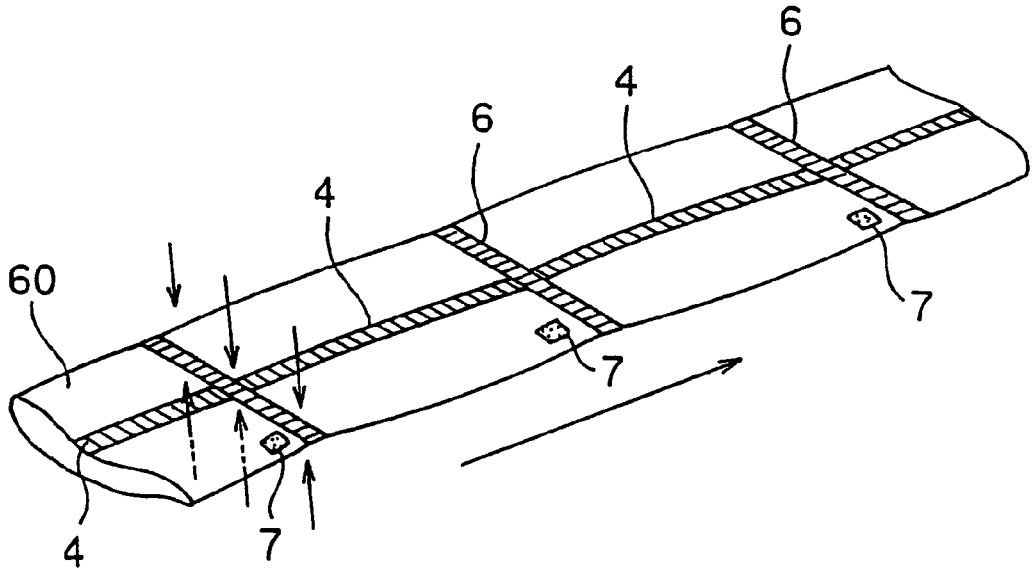
FIG. 8 explains a process for heat-sealing predetermined positions of the cylindrical body shown in FIG. 7, each predetermined position corresponding to the lower end of each packaging bag.

Then, as shown in FIG. 8, heat sealing is carried out by pressing the top and bottom sides of the cylinder 60 at every fixed intervals in its the longitudinal direction, thereby producing both a rear face 3 and a front face 2 of the cylinder 60. The strip-like position of the heat sealing is controlled to be slightly ahead from each rough surface portion 7 and perpendicular to the axis of the cylinder 60. Thus, each lateral heat-sealed portion formed in above manner provides a lower end portion 6 of the packaging bag 1 being formed.

After this, the cylinder 60 is cut at each longitudinal position corresponding to the length of each packaging bag 1. Contents are then accommodated into each packaging bag 1, and the upper end portion of each packaging bag 1 is heat-sealed, with the result that the packaging bag 1 is completed, as shown in FIGS. 1 and 2.

In each packaging bag 1 shown in FIGS. 1 and 2, the rough surface portion 7 functioning as the easy-opening portion is located a little bit inside from the side edge of the packaging bag 1 in the usual packed state. Therefore, it is difficult to tear the packaging bag 1 at a side edge of each packaging bag 1. For this reason, an accident such that a small child etc. accidentally opens the packaging bag 1 can be diminished steadily.

Figure 9A:
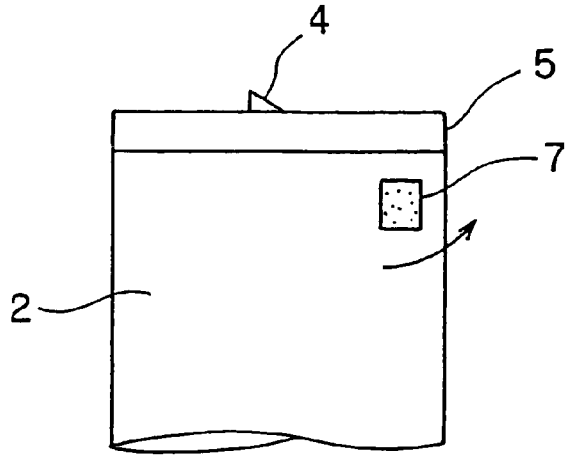
FIGS. 9A to 9C pictorially illustrate the procedures for opening the packaging bag shown in FIGS. 1 and 2.
Figure 9B:
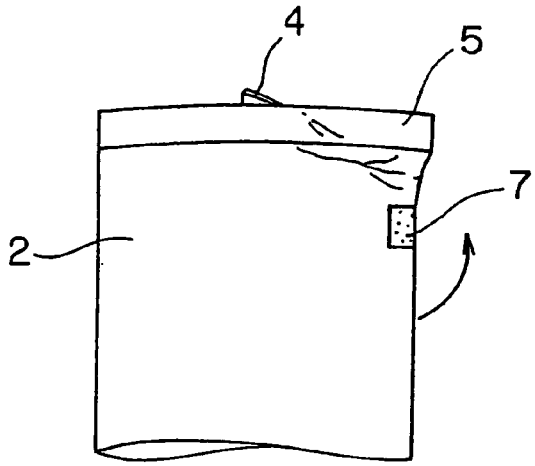
Figure 9C:
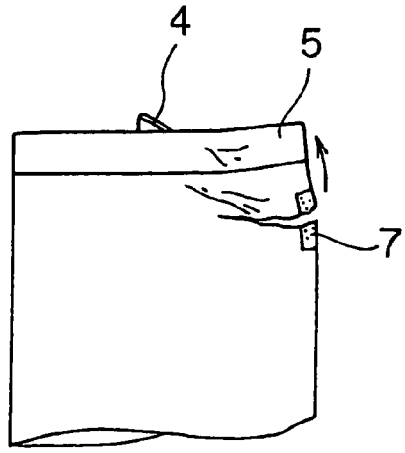

Meanwhile, as shown in FIGS. 9A to 9C, tearing its upper part at which the rough surface portion 7 is formed allows the packaging bag 1 to be opened.

Precisely, first, the upper part of the packaging bag 1 is slightly moved in the right-and-left direction thereof in such a manner that the front face 2 is shifted relatively to the rear face 3 (refer to the state shown in FIG. 9A). Then the rough surface portion 7, which is formed at a slightly inside position from the side edge, is drawn to the side of the packaging bag 1 (refer to the state shown in FIG. 9B). After drawing the rough surface part 7 in such a way, the packaging bag 1 can be torn open by tearing the upper part of the packaging bag 1 with the aid of the rough surface portion 7 (refer to the state shown in FIG. 9C). As a result, the upper end 5 can be separated from the main part of the packaging bag 1. When located at the side edge, the rough surface portion 7 makes it possible to easily tear the upper part of the packaging bag 1 at the rough surface portion 7. This is because the rough surface portion 7 serves as a tearing start position and makes the start of the tearing operation easier.

Moreover, the packaging bag 1 may also be opened in such a way that a user pinches the rough surface portion 7 and bends it with a twisted operation, before tearing the bent rough surface portion 7 by making use of it as the tearing start point.

In addition, the rear heat-sealed portion 4 exists on the rear face 3 of the packaging bag 1. This rear heat-sealed portion 4 is thick in its thickness and hard compared with the material portions of both of the front face 2 and the rear face 3. For this reason, this rear heat-sealed portion 4 will become a hindrance in the middle of opening process when the tip of a cut reaches rear heat-sealed portion 4.

In order to overcome the above inconvenience steadily, the packaging bag 1 of the present embodiment adopts the foregoing rough surface portion 8 servicing as a second easy-opening assist portion is formed on the rear heat-sealed portion 4. This rough surface portion 8 allows the thick and hard rear heat-sealed portion 4 to be cut in a facilitated manner. In addition, the rough surface portion 8, which is produced in a plane form on the rear heat-sealed portion 4, faces directly the other side end opposite to the foregoing side end near to the rough surface portion 7. In other words, since the rough surface portion 8 is located in the same direction as the open-advancing direction, the opening operation can be assisted effectively.

Although the packaging bag with the rear heat-sealed portion formed on the rear face thereof has been explained as an example, the packaging bag according to the present invention is not limited to this sealing configuration. For example, as shown in FIG. 10, the present invention is applicable to a packaging bag 80 whose three side-ends are sealed to form a bag.

Figure 10:
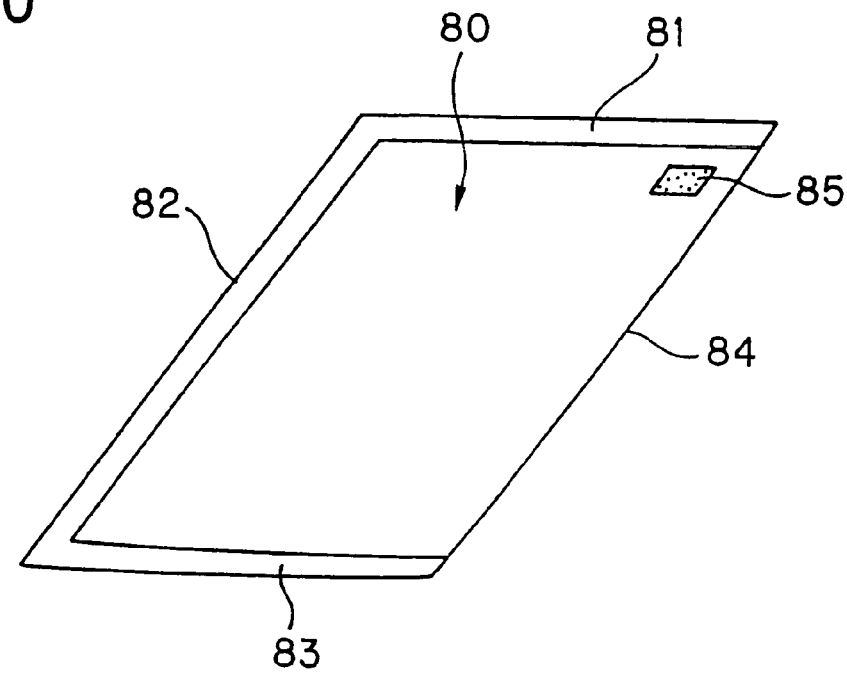
FIG. 10 shows a packaging bag according to a modification on the first embodiment.

The packaging bag 80 shown in FIG. 10 is produced by folding a rectangular sheet material in two, and heat-sealing three overlapped side-ends 81, 82, and 83, respectively. Further, a rough surface portion 85 serving as the easy-opening portion is formed at a location slightly shifted inward from the remaining folded side end 84 of the bag 80. This rough surface portion 85 is also formed so that it remains inward from the side end 84, resulting in that, as described above, the rough surface portion 85 establishes an easier and smoother operation for the bag 80. Moreover, no notch or gathers, which function as the easy-opening portion, are not formed on the perimeter edges 81, 82, 83, and 84 of the packaging bag 80. This also avoids the packaging bag 80 from being opened accidentally in a steady manner.

In the case of opening this packaging bag 80, the rough surface portion 85 is moved to the position corresponding to the side edge 84, so that the rough surface portion 85 can be used as a starting position for opening.

SECOND EMBODIMENT

Referring to FIGS. 11 to 15, a second embodiment of the packaging member according to the present embodiment.

Figure 11:
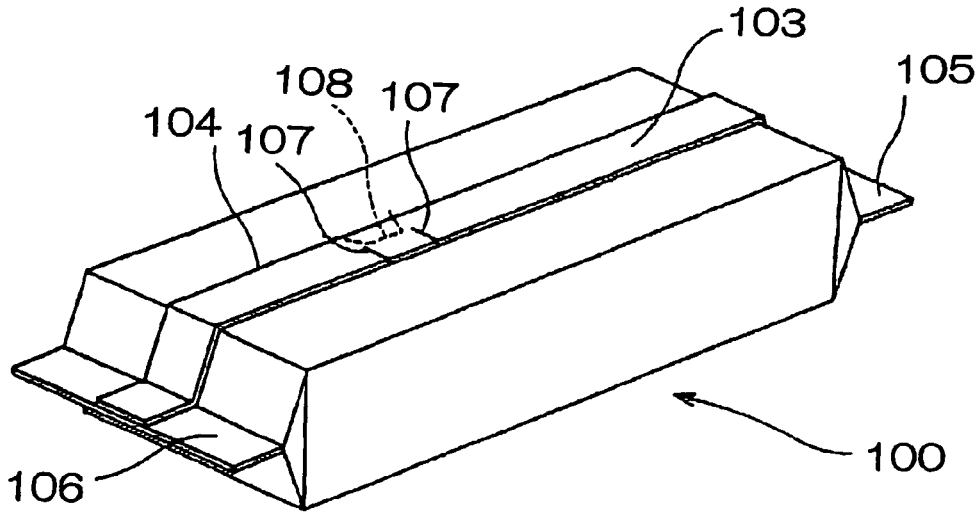
FIG. 11 is a perspective view of a packaging container, which is described as the second embodiment of the packaging member according to the present invention.

FIG. 11 shows an example of the present invention, which is suitable for a box-shaped packaging container that accommodates food like sweet jelly of beans therein.

Figure 12:
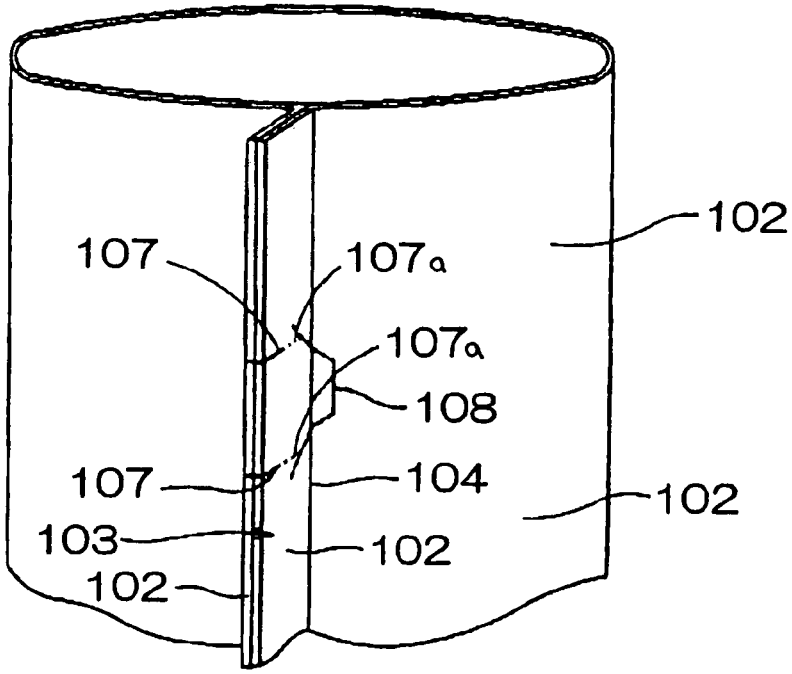
FIG. 12 is an enlarged, but partly cut perspective showing a middle stage of forming the packaging container according to the present invention.

As shown in FIGS. 11 and 12, a packaging container 100 is formed into a box shape. That is, two side edges 102*a* of a rectangular-shaped laminate film material 102 are mutually joined in a longitudinal direction in a palm-to-palm manner to form a cylinder. Joining the palm-to-palm portions to each other then forms a palm-to-palm joined portion 103. The palm-to-palm joined portion 103 is folded toward a main part 102*b* of the laminate film material 102 through a folding line 104 existing thereon. By closing cylindrically shaped openings at both longitudinal ends of the cylinder, sealed portions 105 and 106 are formed.

Figure 13:
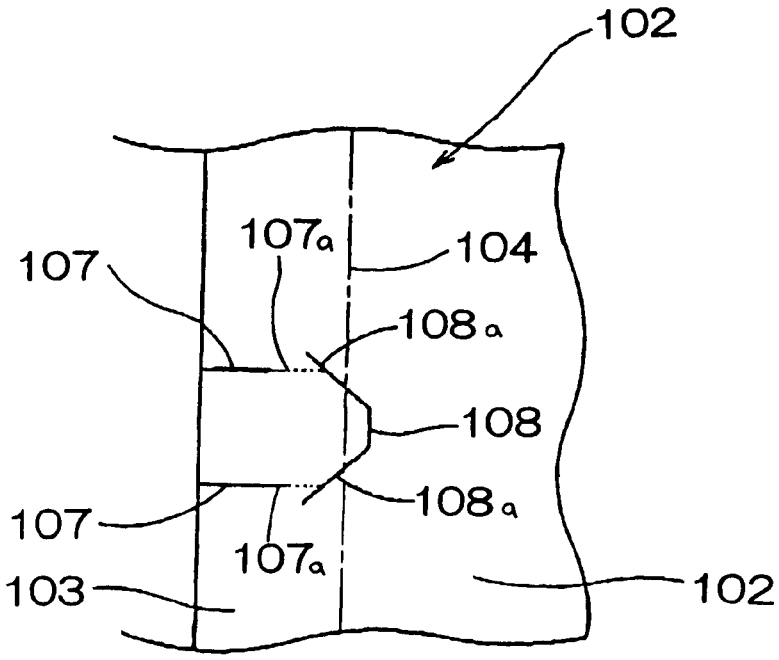
FIG. 13 shows an example of a cutting line formed on the main part side of the packaging container.

As shown in FIGS. 12 and 13, the packaging container 100 has two cutting portions 107 formed at predetermined longitudinal positions of the palm-to-palm joined portion 103. A palm-to-palm joined portion may also be described as joining opposite ends of a common surface of a sheet or film together. The two cutting portions 107 are located at intervals of about 10 mm, where the intervals are equivalent to a pinching width.

Practically, the two cutting portions 107 are prolonged from an outside edge of the palm-to-palm joined portion 103 along the lateral direction to a folding line 104 over a distance of about ½ of the width (overlapped strip portion) of the palm-to-palm joined portion 103. A portion separated by the two cutting portions 107 of the palm-to-palm joined portion 103 forms a pinching portion 110.

Moreover, a trapezoidal cutting line 108 is formed on main part side 102*b* closely to the folding line 104 correspondingly to the two cutting portions 107.

The above-mentioned trapezoidal cutting line 108 is formed by perforations having both of 1 mm-cut portions and 0.5 mm-continuous portions placed by turns. The depth of the perforations is limited within the thickness of the material, i.e., so as not to reach a back layer thereof.

As shown in FIG. 13, the trapezoidal cutting line 108 consists of a straight segment and inclined prolonged ends 108*a* prolonged obliquely from the segment. Both of the inclined prolonged ends 108*a* extend from the side of the main part 102*b* to cross the folding line 104, and further extend to or beyond the points where the inclined prolonged ends 108*a* each encounter virtual extended lines 107*a* from the cutting portions 107 formed in the palm-to-palm joined portion 103.

Both of the inclined ends 108*a* of the trapezoidal cutting line 108 extended from the main part side 102*b* may be ended at the crossed position with the folding line 104. In this case, both the inclined prolonged ends 108*a* of the trapezoidal cutting line 108 are arranged to reach the virtual extended lines 107*a* extended from the cutting portions 107. The trapezoidal cutting line 108 may be a circular arc cutting line (as shown in FIG. 14) or a triangular shape.

In other words, any shape can be applied to the cutting line 108, as long as the cutting line 108 cannot be torn when the palm-to-palm joined portion 103 is folded to the main part side by using a positioning-reliance-board which is not shown.

Figure 14:
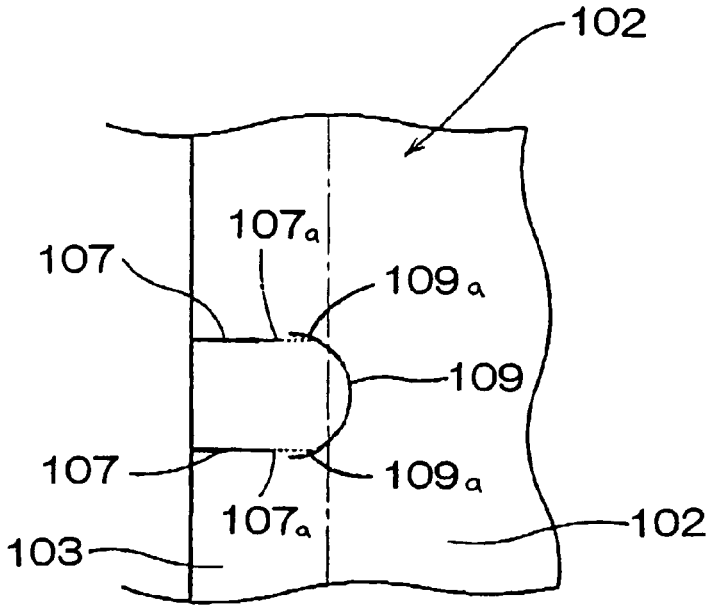
FIG. 14 shows another example of a cutting line formed on the main part side of the packaging container.

The above-mentioned circular arc cutting line 109 is, like the trapezoidal cutting line 108 shown in FIG. 14, formed by the perforations having the 1 mm-cut portions and the 0.5 mm-continuous portions by turns. The depth of the perforations is determined not to reach a back layer of the material.

Like the trapezoidal cutting line 108, both ends 109*a* of the circular arc cutting line 109 extend to cross the folding line 104 from the side of the main part 102*b*. Both ends 109*a* further extend to or beyond the points where the extended ends 109*a* each encounter virtual extended lines 107*a* extended from the cutting portions 107 formed in the palm-to-palm joined portion 103. Both of the ends 109*a* of the circular arc cutting line 109 may be ended at given positions on the folding line 104. In this case, it is preferred that both ends 109*a* of the circular arc cutting line 109 are located to encounter the virtual extended lines 107*a* from the cutting portions 107 at the given positions on the folding line 104.

The foregoing plastic laminate film material 102 can be formed of any material selected from the group of materials consisting of a laminate film of a vacuum evaporated biaxial oriented polyester film with a thickness of 12 microns, monoaxial oriented polyethylene film with a thickness of 18 microns, and a low-density polyethylene film with a thickness of 20 microns; a laminate film of a vacuum evaporated biaxial oriented polyester film with a thickness of 12 microns, monoaxial oriented polypropylene film with a thickness of 25 microns, and a low-density polyethylene film with a thickness of 20 microns; a laminate film of biaxial oriented polyester film with a thickness of 12 microns, aluminum foil with a thickness of 7 microns, monoaxial oriented high-density polypropylene film with a thickness of 18 microns, and a low-density polyethylene film with a thickness of 20 microns; a laminate film of biaxial oriented polyester film with a thickness of 12 microns, aluminum foil with a thickness of 7 microns, monoaxial oriented polypropylene film with a thickness of 25 microns, and a low-density polyethylene film with a thickness of 20 microns.

In addition, in the foregoing embodiment, a pair of cutting portions has been formed at a specified end position of the palm-to-palm joined portion 103. Alternatively, two pairs of cutting portions may be formed at two specified end positions apart from each other in the longitudinal direction of the palm-to-palm joined portion 103, if the box-shaped packaging container 100 is shaped into a slender form.

The method of forming the box-shaped packaging container 100 will now be explained.

The three-layer laminate film comprising a vacuum evaporation biaxial oriented polyester film, a monoaxial oriented polyethylene film, and a low-density polyethylene film is selected as the film material 102. The selected film material 102 is then cut in a rectangular shape corresponding to a desired box-shaped packaging container 100.

The trapezoidal cutting line 108 is then formed at a given position of the rectangular-cut film material 102, the given position being located, on the main part 102*a*, beyond the folding line 104 of the palm-to-palm joined portion 103 to be produced on the film material 102. Further, the trapezoidal cutting line 108 is formed to face the two cutting portions (lines) 107 to be formed at given positions of the palm-to-palm joined portion 103. The trapezoidal cutting line 108 is formed from the surface layer, but is limited so as not to reach the back layer of the film material 102. For example, such depth is set to an amount that penetrates through both the vacuum evaporation biaxial oriented polyester film and the monoaxial oriented polyethylene film, but limited within the thickness of the film material 102. This trapezoidal cutting line 108 may be formed into another form such as a circular arc cutting line 109.

Both ends 108*a* of the trapezoidal cutting line 108, which cross the folding line 104 from the side of the main part 102*b*, are extended to or beyond the points where both of the extended ends 108*a* each encounter virtual extended lines 107*a* extended from the cutting portions 107.

As shown in FIG. 12, longitudinal side edges 102*a* of the film material 102 are overlapped one on the other in a palm-to-palm manner to form a cylinder, with the low-density polyethylene film placed inside. A palm-to-palm joined portion 103 is then formed by mutually joining the low-density polyethylene film of the palm-to-palm portions through the heat welding.

Two cutting portions (lines) 107 are then formed at given end positions of the palm-to-palm joined portion 103, so that the cutting portions 107 are arranged in a face-to-face manner toward the trapezoidal cutting line 108 formed in the main part 102*b*. The length of the two cutting portions 107 is about ½ of the overlapped width of the palm-to-palm joined portion 103. In this case, the two cutting portions 107 are formed so that their virtual extended lines 7*a*, 7*a* each meet both ends 8*a* of the trapezoidal cutting line 108 or each cross such both ends 8*a*.

The palm-to-palm joined portion 103 is then folded at the folding line 104 toward the main part 102*b* with a positioning-reliance board (not shown) applied to the folding line 104. One circular opening of the cylinder is sealed through heat-welding the low-density polyethylene film so as to form a sealed portion 105.

In this case, the positioning-reliance board is located so as not to touch the straight-line portion of the trapezoidal cutting line 108, the straight-line portion being in parallel with the folding line 104. This location makes it possible that the trapezoidal cutting line 108 will not be torn due to the positioning-reliance board, when the palm-to-palm joined portion 103 is folded toward the main part 102*b* at the position of the folding line 104.

Subsequently, food such as sweet jelly of beans is pressure-filled into the box-shaped packaging container through the other opening thereof. After pressure-filling the food, the opening that has been unsealed so far is sealed through heat-welding the low-density polyethylene film so as to form the other sealed portion 6 at the other end of the container. As a result, the box-shaped packaging container 100 accommodating the food like sweet jelly of beans therein has been produced.

In contrast, when taking out the contents from the box-shaped packaging container 100, the container 100 should be torn off. For tearing the container 100, the palm-to-palm joined portion 103 that has been folded is first raised from the main part 102 by a predetermined angle. The joined piece between the two cutting portions 107 of the raised palm-to-palm joined portion 103 is pulled off toward the direction away from the box-shaped packaging container 100. The palm-to-palm joined portion 103 can therefore be torn responsively to pulling the two cutting portions 107 serving as a starting point for opening, so that a pinching portion 110 is formed.

By pulling the pinching portion 110 farther away, the palm-to-palm joined portion 103 will be torn along with the virtual extended lines 107*a* following the two cutting portions 107. When the tip of this torn piece reaches both ends 108*a* of-the trapezoidal cutting line 108, the torn piece is transferred, by way of both ends 108*a* and beyond the folding line 104, to the straight-line portion of the trapezoidal cutting line 108 arranged in the main part 102*b*. This transfer will cause the straight-line portion of the trapezoidal cutting line 108 to be torn off, thereby separating the pinching portion 110 from the portion 103 connected to the main part 102*b*.

Figure 15:
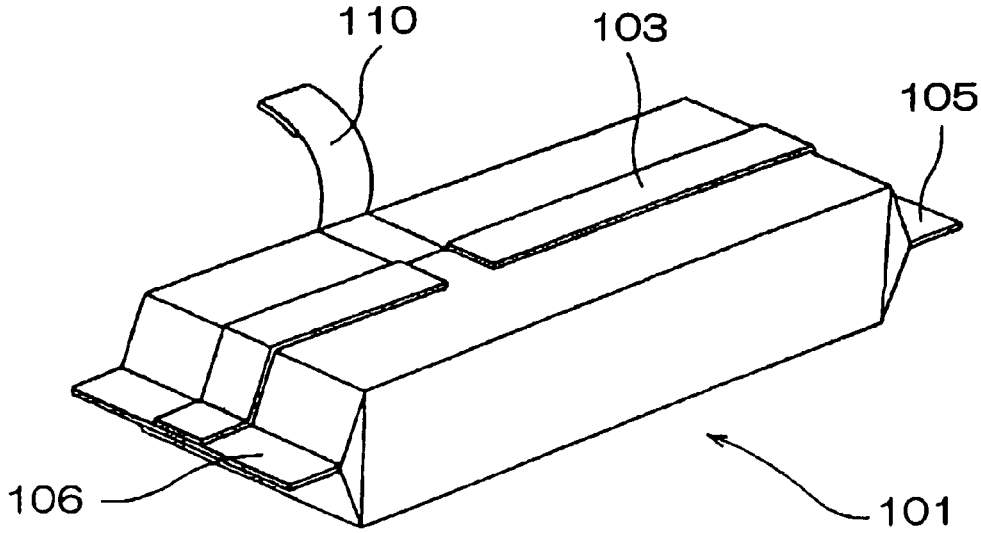
FIG. 15 explains an opening operation to open the packaging container according to the present invention.

When the pinching portion 110 is pulled further, as shown in FIG. 15, the pinching portion 110 opens the main part 102*b* along a circumference thereof with its width held. Accordingly, it is possible to tear the box-shaped packaging container 100 in a ring form at a middle position in the longitudinal direction. The contents that have been accommodated in the box-shaped packaging container 100 can therefore be taken out.

The present invention may be embodied in other specific forms without departing from the spirit or essential characteristics thereof. The above embodiments and modifications are therefore to be considered in all respects as illustrative and not restrictive, the scope of the present invention being indicated by the appended claims rather than by the foregoing description and all changes which come within the meaning and range of equivalency of the claims are therefore intended to be embraced therein.

The entire disclosure of Japanese Patent Applications No. 2001-329071 filed on Oct. 26, 2001 and No. 2001-377612 filed on Dec. 11, 2001 including the specification, claims, drawings and summary is incorporated herein by reference in its entirety.

INDUSTRIAL APPLICABILITY

The present invention provides, as one mode of the packaging member, a packaging bag that can be prevented from being opened accidentally (unintentionally), while still maintaining an easy-opening characteristic. In addition, the present invention provides, as another mode of the packaging member, a packaging container that can be opened along its circumference to take out its contents, with avoiding a fractured line from being torn apart due to the application of a positioning-reliance board, when a palm-to-palm joined portion is folded toward the main part of the packaging container. Hence the present invention is able to improve the packaging member in its opening performance.

The invention claimed is:

1. A packaging container comprising:

a rectangular laminate film material, a palm-to-palm joined portion formed by overlapping and joining both longitudinal side edges of the rectangular laminate film material, forming a cylinder, the palm-to-palm joined portion being folded toward a remaining main part of the cylindrical member through a folding line set thereon;

two latitudinal sealed portions, formed by sealing two open ends of the cylinder; and easy-tearing means comprising:

two cutting lines formed in the palm-to-palm joined portion so as to laterally extend from an edge side of the palm-to-palm joined portion, and a further cutting line formed at a position on the main part of the cylindrical member near the folding line of the cylinder and extending across the folding line of the palm-to-palm joined-portion, said further cutting line having a depth less than the thickness of the laminate film material, said further cutting line intersecting on said palm-to-palm joined portion two lines extending from the two cutting lines, respectively.

2. The packaging container according to claim 1, wherein the further cutting line is an arc having a center located on the main part of the cylindrical member and ends located on the palm-to-palm joined portion.

3. The packaging container according to claim 1, wherein the further cutting line comprises a first portion substantially parallel to the folding line of the palm-to-palm joined portion, and substantially straight second portions connected to ends of said first portion and intersecting at obtuse angles each of the lines extending from the two cutting lines, respectively.

4. The packaging container according to claim 1, wherein the laminate film material has a three-layer structure of a biaxial oriented polyester film, a monoaxial oriented high-density polyethylene film, and a polyethylene film.

5. The packaging container according to claim 1, wherein the laminate film material has a three-layer structure of a biaxial oriented polyester film, a monoaxial oriented polypropylene film, and a polyethylene film.

6. The packaging container according to claim 1, wherein the laminate film material has a four-layer structure of a biaxial oriented polyester film, an aluminum foil, a monoaxial oriented polypropylene film, and a polyethylene film.

* * * * *